US007008136B2

(12) United States Patent
Hill

(10) Patent No.: US 7,008,136 B2
(45) Date of Patent: Mar. 7, 2006

(54) CRACK SEALING APPARATUS WITH HEATED HOSE THROUGH

(75) Inventor: Ken Hill, Wickenburg, AZ (US)

(73) Assignee: Bearcat Manufacturing, Inc., Wickenburg, AZ (US)

( * ) Notice: Subject to any disclaimer, the term of this patent is extended or adjusted under 35 U.S.C. 154(b) by 0 days.

(21) Appl. No.: 10/707,101

(22) Filed: Nov. 20, 2003

(65) Prior Publication Data

US 2004/0101366 A1 May 27, 2004

Related U.S. Application Data

(60) Provisional application No. 60/427,709, filed on Nov. 20, 2002.

(51) Int. Cl.
*E01C 23/02* (2006.01)

(52) U.S. Cl. ..... 404/107; 404/111; 404/108; 404/101

(58) Field of Classification Search ..... 404/111, 404/109, 107, 101, 108
See application file for complete search history.

(56) References Cited

U.S. PATENT DOCUMENTS

| | | | | |
|---|---|---|---|---|
| 3,332,581 | A * | 7/1967 | Eastabrooks | 222/504 |
| 4,812,076 | A * | 3/1989 | Yant | 404/108 |
| 5,232,306 | A | 8/1993 | Sterner | |
| 5,251,999 | A * | 10/1993 | McCracken | 404/109 |
| 5,419,654 | A * | 5/1995 | Kleiger | 404/101 |
| 5,765,963 | A | 6/1998 | Roberts | |
| 6,109,826 | A * | 8/2000 | Mertes | 404/95 |
| 6,619,881 | B1 | 9/2003 | Harvey | |
| 6,619,882 | B1 | 9/2003 | Harvey | |

* cited by examiner

*Primary Examiner*—Raymond W Addie
(74) *Attorney, Agent, or Firm*—Snell & Wilmer L.L.P.

(57) ABSTRACT

A crack sealing apparatus having a heated hose trough is presented which eliminates the need to purge or clean the hose and/or applicator wand that is used to apply sealant to cracks in a roadway. In accordance with one embodiment of the invention, the crack sealing apparatus includes a repository for storing and heating sealant, a hose attached to the repository, a pump for transporting sealant from the repository through the hose, a trough for retaining and heating the hose, and a tubular member located within the trough having a hot liquid or gas circulating therethrough for heating sealant contained within the hose.

21 Claims, 7 Drawing Sheets

CRACK SEALING APPARATUS WITH HEATED HOSE THROUGH

CROSS REFERENCE TO RELATED APPLICATIONS

This application claims the benefit of, and priority to, provisional application Ser. No. 60/427,709, filed Nov. 20, 2002, which application is hereby incorporated by reference in its entirety.

FIELD OF INVENTION

The present invention generally relates to an apparatus for applying a liquid sealant to cracks that occur in roadways. More particularly, the present invention relates to an apparatus for sealing cracks in roadways that includes a heated trough for retaining and heating a hose and applicator gun which are used to apply sealant to the cracks.

BACKGROUND OF THE INVENTION

Cracks in roadways are a recurring problem which, if not sealed or fixed, eventually result in wider crevices and/or potholes in the roadways. Wide crevices and potholes in roadways make it difficult and dangerous to drive.

Various machines and apparatus for sealing cracks in roadways are well known in the prior art. For example, U.S. Pat. Nos. 6,619,881 and 6,619,882 disclose a roadway crack sealing apparatus having a mobile vehicle with a crack sealing assembly that includes fill and sealant hoppers that are located such that an operator of the apparatus has a view that allows him to locate and follow an elongated crack while the vehicle is moving in the forward direction. These patents also disclose a shroud that surrounds a nozzle for dispensing sealant where the hollow shroud is in communication with a pipe that is connected to the exhaust pipe of the vehicle so that hot exhaust gases are directed into the shroud to enable heating of the sealant.

Other prior art crack sealing machines such as those disclosed in U.S. Pat. No. 5,232,306 and U.S. Pat. No. 5,765,963 fail to disclose any means for heating the sealant within the hose or applicator wand to avoid having the sealant harden within the hose or wand. Some currently operating crack sealing machines utilize a hole contained within the apparatus in which a hose or applicator wand can be inserted to recirculate the sealant. This ensures that the sealant does not harden within the hose and/or applicator wand when workers are taking a break or are otherwise indisposed from filling cracks with the sealant.

Still other currently operating crack sealing machines utilize electrically heated hoses to prevent sealant in the hose from hardening. However, these electrically heated hoses are expensive and can easily be broken due to their fragility.

Accordingly, there is a need for a crack sealing apparatus which includes an easy and cost-effective way to heat sealant contained within a hose and/or applicator wand that is used to apply sealant to the roadway. Maintaining the sealant in a heated state will ensure that it does not harden within the hose or wand between applications and eliminates the need to clean out the hose or wand. Moreover, eliminating the need for an operator to clean out the hose or wand makes operation of the apparatus much more safe for the user/operator.

SUMMARY OF INVENTION

The present invention is directed to a crack sealing apparatus which includes a repository for storing sealant, a hose attached to the repository for dispensing the sealant, a heated housing for retaining the hose during application of the sealant, and a pump for transporting the sealant from the repository through the hose. The heated housing may comprise a trough having a tubular member or pipe having a hot liquid or gas circulating therethrough to heat the hose.

In accordance with one aspect of the invention, the tubular member or pipe may be positioned along a bottom interior surface of the trough so that the hose can rest directly on top of the tubular member or pipe. The hot liquid or gas circulating through the tubular member or pipe serves to heat the hose. A cover member, such as a rubber flap, may also be included to enclose the trough and retain the heat within the trough.

In one exemplary embodiment of the invention, the tubular member may comprise a pair of parallel tubular members, such as pipes, having a pair of first ends and a pair of second ends. The pipes are positioned in the bottom interior of the trough with the pair of first ends connected to the repository which contains the sealant and the pair of second ends connected to a second, smaller trough member that is designed to hold or retain an applicator wand or gun that is connected to the hose. The second, smaller trough member contains an interior recirculation loop which redirects hot liquid or gas circulating through one tubular member or pipe back toward the repository through the opposite parallel tubular member or pipe.

The pair of first ends of the parallel tubular members that are connected to the repository are preferably connected to other tubular members or pipes contained within the repository which also circulate hot liquid or gas therethrough to keep the sealant in the repository warm and prevent it from hardening. The tubular members or pipes contained within the repository are connected to a hot liquid or gas source to provide a hot liquid or gas for circulating through the pipes. Alternatively, the pair of first ends may be connected directly a hot liquid or gas source instead of additional pipes contained within the repository if the sealant in the repository is heated by some other means.

In another exemplary embodiment of the invention, the trough member may include a plurality of trough sections that are fit together to provide an upper trough and a lower trough with the upper trough positioned directly above the lower trough. A separate support section of the trough may be used to connect the upper trough to the lower trough and at least one attachment member may be used to connect the trough to the apparatus. The configuration of the trough which includes an upper trough and a lower trough enables the use of gravity to assist in draining the sealant from the hose but is just an added benefit, and not entirely necessary, since the sealant does not harden in the hose due to the heated trough.

The present invention includes an apparatus where the hose containing sealant and the applicator wand or gun containing sealant are both heated and can therefore be left full of sealant without having the sealant harden within the hose of the applicator. The hose and applicator are heated by being retained within a housing which includes a continuous line or pipe containing a hot liquid or gas that is recirculated through the line or pipe. The apparatus of the present invention eliminates the need to purge and clean out the hose and applicator wand by maintaining the sealant contained within the hose and applicator in a liquid, nonhardened state. Further, eliminating the need to purge and clean out the hose and applicator increases a user' s safety by eliminating the need to use chemicals and other dangerous solvents necessary to remove hardened sealant.

BRIEF DESCRIPTION OF DRAWINGS

The subject invention will hereinafter be described in conjunction with the appended drawing figures, wherein like numerals denote like elements, and.

DETAILED DESCRIPTION

Figure 1:
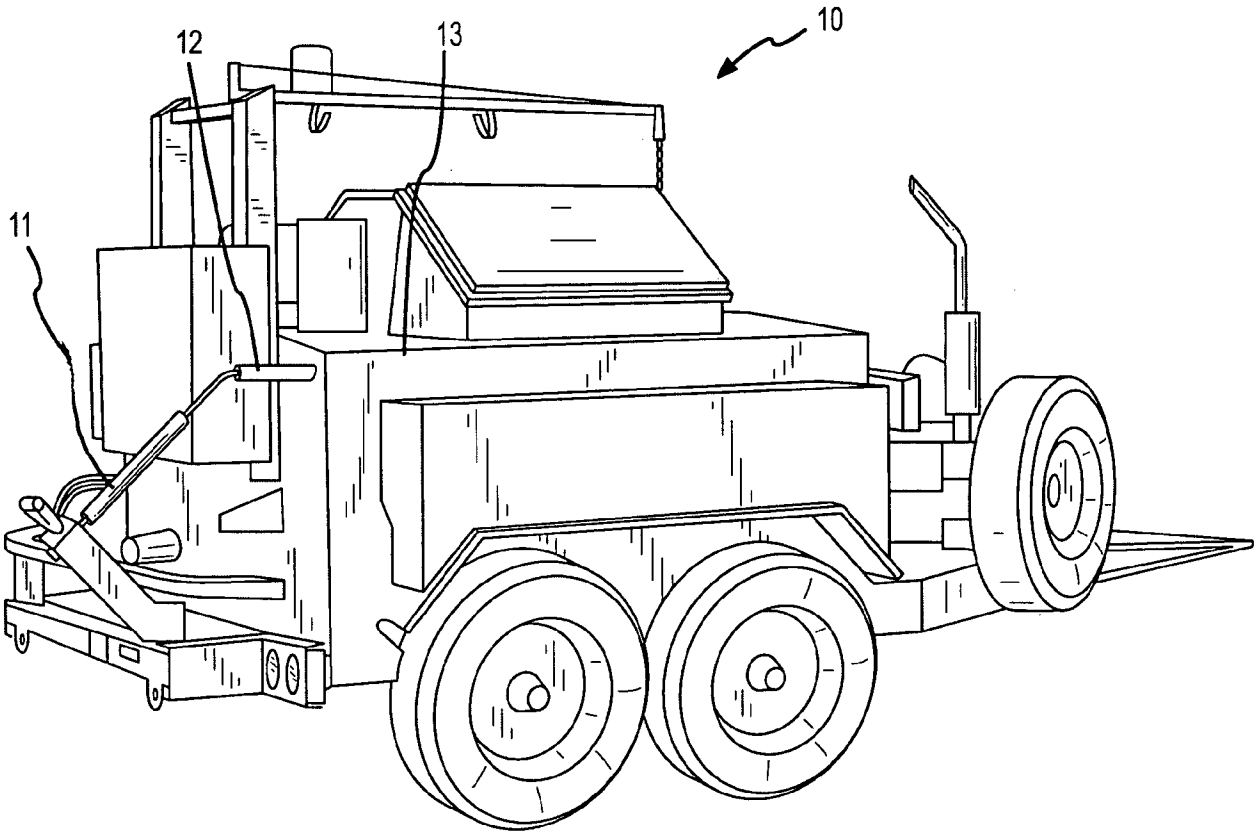
FIG. 1 is a perspective view of a prior art crack sealing apparatus.

Turning now to the figures, FIG. 1 shows a perspective view of a prior art crack sealing apparatus 10 having an applicator wand 11. In order to keep sealant from hardening in applicator wand 11, crack sealing apparatus 10 includes an opening 12 in a sealant repository 13 through which applicator wand 11 can be inserted in order to recirculate the sealant. Recirculating the sealant through the sealant repository and the applicator wand prevents the sealant from hardening in the applicator wand.

Figure 2:
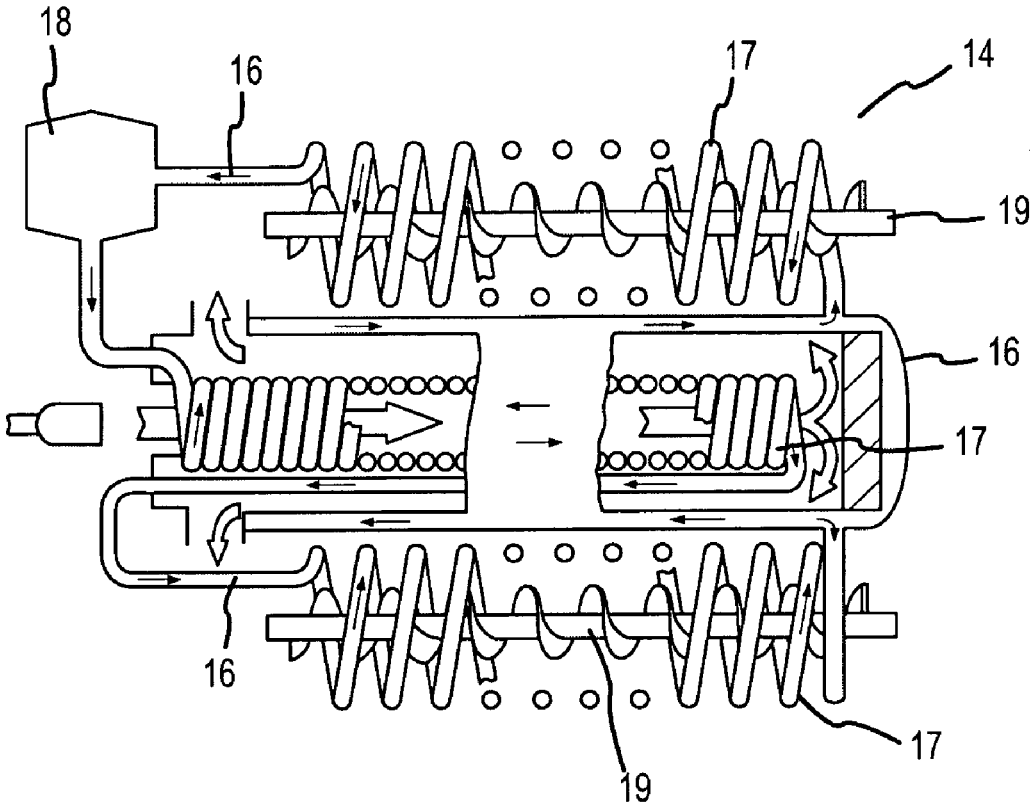
FIG. 2 is a schematic showing a closed indirect heating system for heating a sealant contained within a repository with a closed loop line or pipe having a hot liquid or gas recirculating therethrough.

The sealant is kept in the liquid form in the sealant repository by a heating system contained within the sealant repository. FIG. 2 shows a schematic drawing depicting a closed indirect heating system for heating a sealant contained within a repository with a closed loop line or pipe having a hot liquid or gas recirculating through the closed loop line or pipe. Sealant repository 14 contains a closed loop line or pipe 16 which may be configured in one or more coils 17. A hot liquid or gas pump 18, such as a hot oil pump, recirculates hot liquid or gas through the closed loop line or pipe 16 to heat sealant contained in sealant repository 14. Agitator elements 19 may also be included within sealant repository 14 for mixing the heated sealant.

Figure 3:
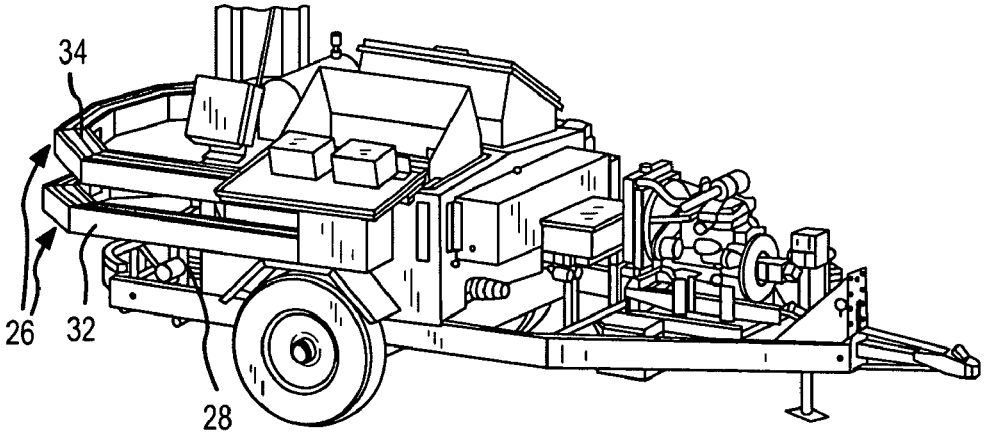
FIG. 3 is a perspective view of the crack sealing apparatus of the present invention taken from one side of the apparatus.
Figure 4:
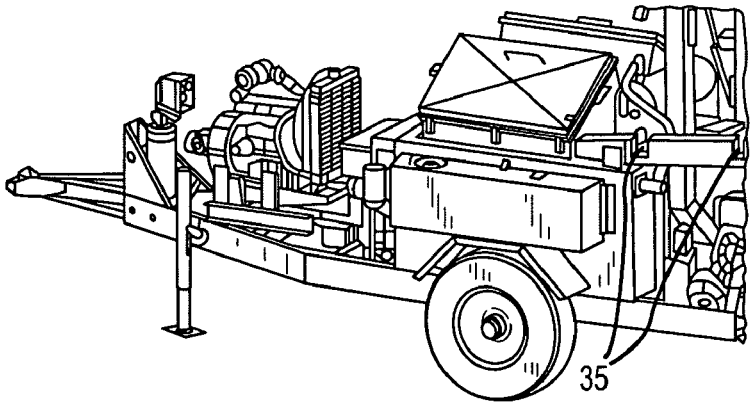
FIG. 4 is a perspective view of the crack sealing apparatus of the present invention taken from the opposite side of the apparatus.
Figure 5:
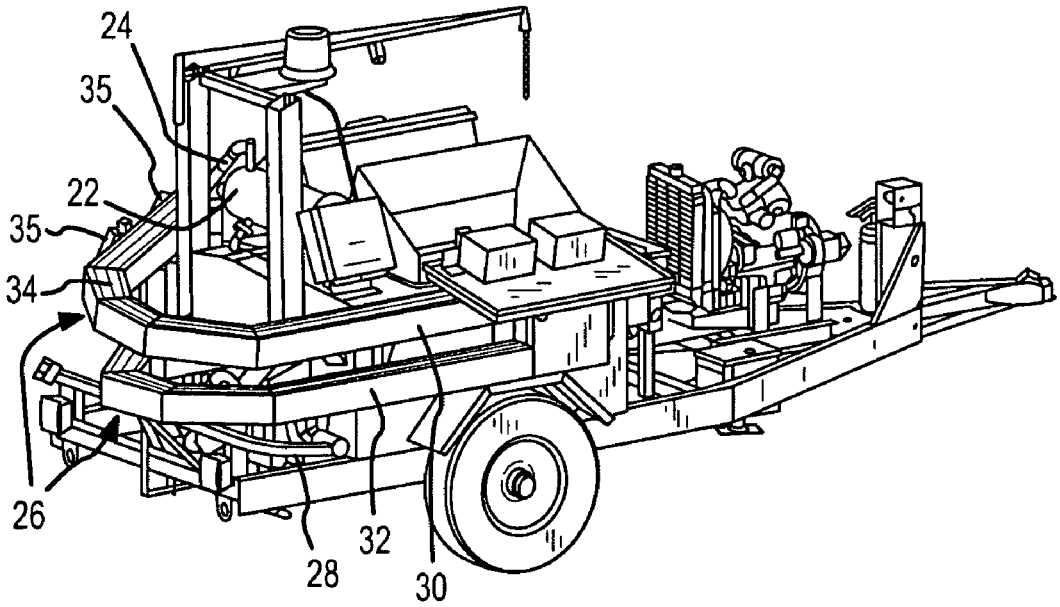
FIG. 5 is a perspective view of the crack sealing apparatus of the present invention taken from a rear of the apparatus.

The present invention generally provides a crack sealing apparatus having a heated hose trough designed to heat a hose and applicator wand used to distribute sealants so that the sealant is prevented from hardening within the hose and/or applicator wand. Referring to FIG. 1, a crack sealing apparatus 20 in accordance with the present invention generally includes a sealant repository 22, a hose 24 for transporting sealant attached to the sealant repository 22, a heated housing 26 for retaining hose 24, and a pump 28 for pumping sealant from the sealant repository 22 through hose 24 so that sealant can be applied to a roadway. As shown in FIGS. 3 through 5, heated housing 26 may include an upper trough 30 positioned directly above a lower trough 32. Further, a cover 34 may be attached to upper and lower troughs 30, 32 to enclose upper and lower troughs 30, 32 to retain heat within troughs 30, 32. One or more attachment members 35 may also be included to attach upper trough 30 and/or lower trough 32 to crack sealing apparatus 20.

Most all of hose 24 and an applicator wand (not shown) which is attached to hose 24 are contained within upper and lower troughs 30, 32. An applicator wand (not shown) attached to hose 24 is retained in upper trough 30. The configuration of the upper and lower troughs 30, 32 utilize gravity to drain sealant from the applicator wand (not shown) and hose 24. This configuration which utilizes gravity to drain sealant away from the applicator wand and hose is merely an added benefit in that heating of the sealant within the applicator wand and hose make it unnecessary to drain sealant from the applicator wand and hose because sealant is prevented from hardening in the applicator wand and hose.

Figure 6:
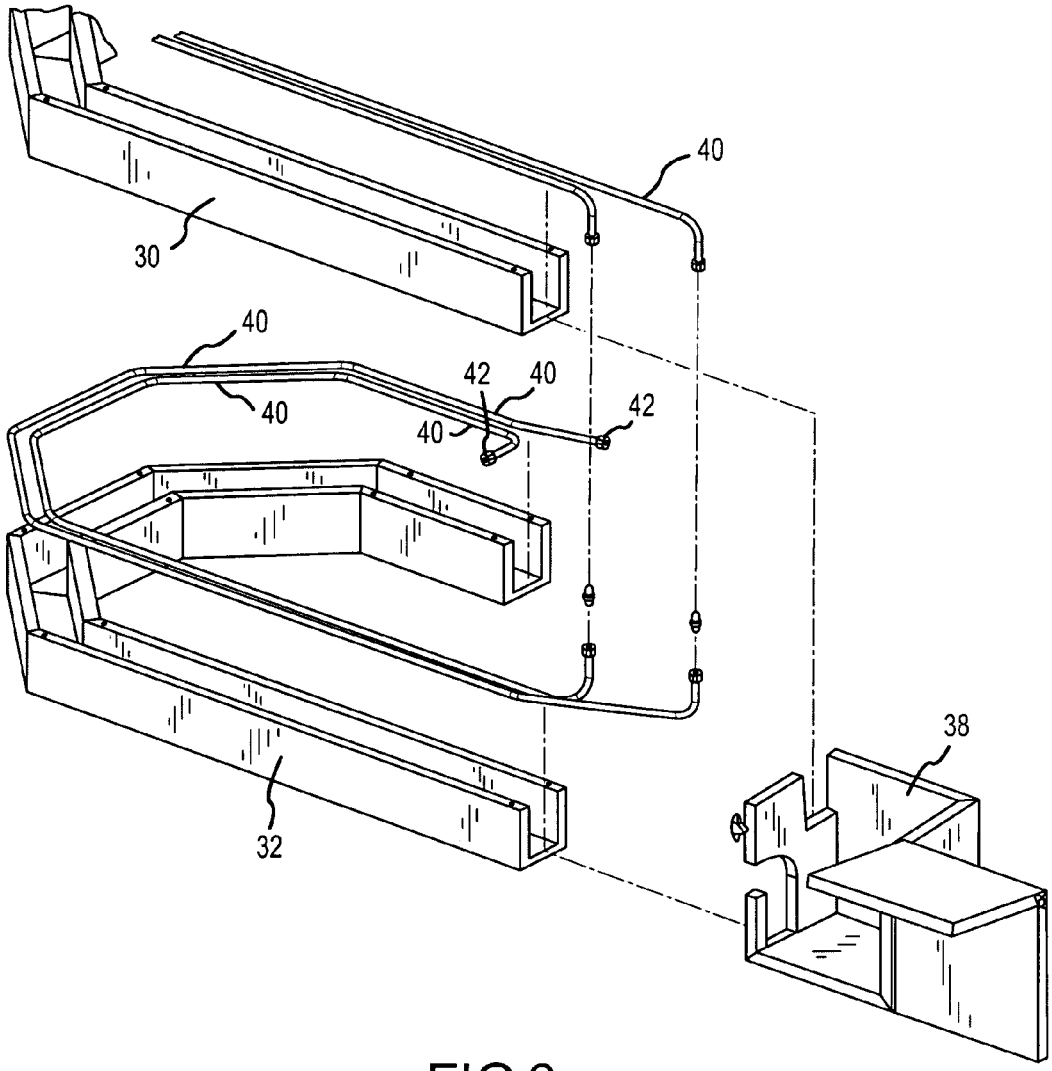
FIG. 6 is an exploded perspective view of the upper and lower trough sections of the crack sealing apparatus of the present invention.

FIG. 6 shows an exploded perspective view of the upper and lower trough sections 30, 32 of the crack sealing apparatus 20 of the present invention. Upper and lower trough sections 30, 32 are connected with a support trough 38. Upper and lower trough sections 30, 32 and support trough 38 contain a pair of parallel tubular members 40 which, when connected, form one continuous loop. Parallel tubular members 40 include a pair of first ends 42 and a pair of second ends 44. The pair of first ends 42 are connected to a closed loop line or pipe contained in the sealant repository which is used to heat the sealant by recirculating the hot liquid or gas through the closed loop line or pipe (see FIG. 2). Alternatively, the pair of first ends 42 of parallel tubular members 40 may be directly connected to a pump which provides a source of a hot liquid or gas that can be recirculated through parallel tubular members 40.

The pair of second ends 44 of parallel tubular members 40 are connected to a second, smaller trough member 46 which includes a recirculation loop contained therein which redirects the hot liquid or gas circulating through parallel tubular members 40 back in the direction of the sealant repository or pump used as a source of hot liquid or gas.

It will be understood by those skilled in the art that upper and lower trough sections 30, 32 may be comprised of a plurality of trough sections and that parallel tubular members 40 may be comprised of a plurality of tubular members or pipes sequentially connected to one another. Moreover, parallel tubular members 40 may also comprise one continuous tubular member that is formed in a closed, continuous loop.

Figure 7:
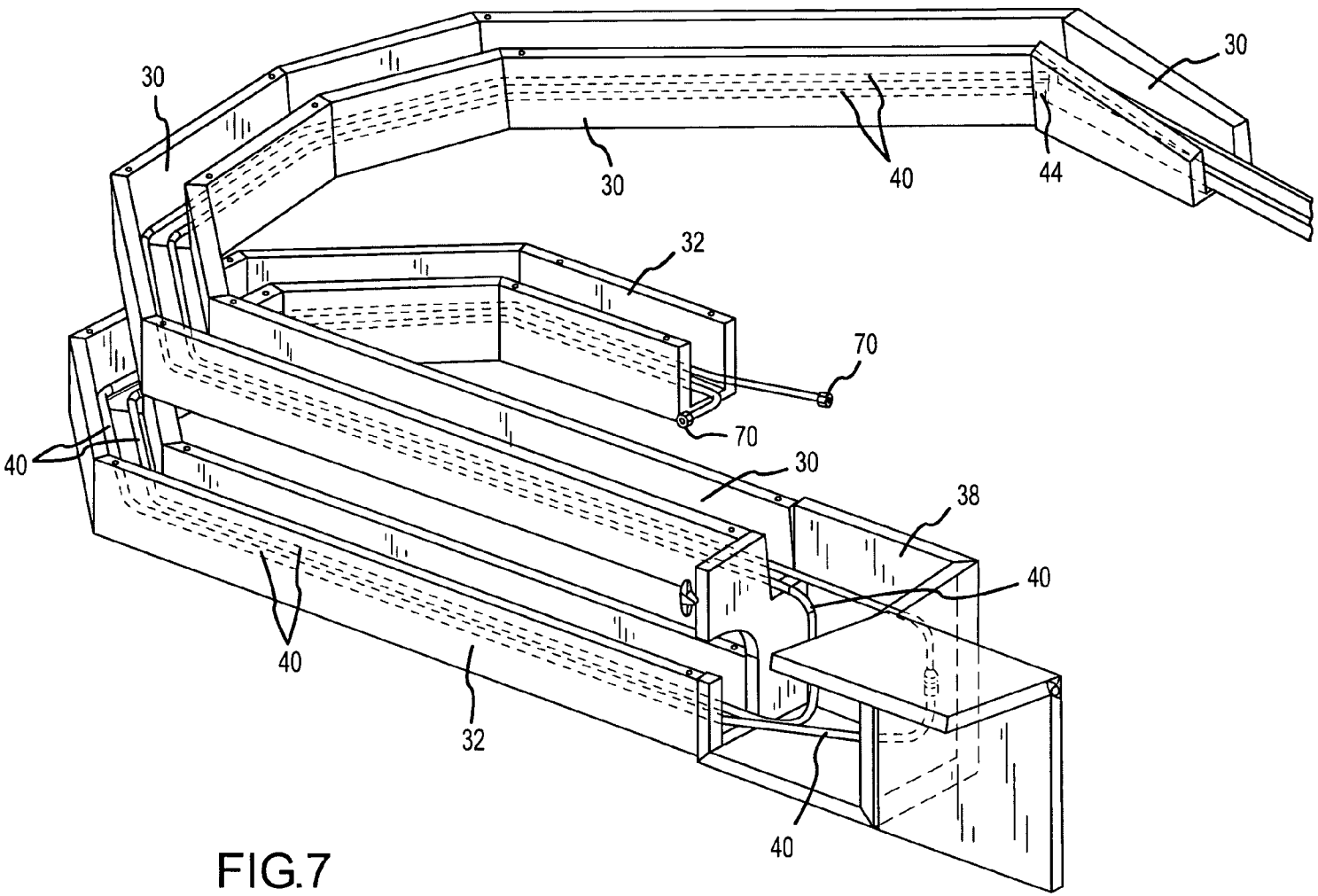
FIG. 7 is a perspective view of the upper and lower trough sections of the crack sealing apparatus of the present invention with portions of the trough and the tubular member for circulating hot liquid or gas contained within the trough shown in phantom.

FIG. 7 is a perspective view of the upper and lower trough sections 30, 32 of the crack sealing apparatus 20 of the present invention with portions of the trough and the parallel tubular members 40 for circulating hot liquid or gas contained within the trough shown in phantom. FIG. 7 shows upper and lower trough sections 30, 32 and support trough 38 all connected to one another to form one continuous trough. Parallel tubular members 40 are positioned within the continuous trough on an interior bottom surface of the trough with the exception of those portions of the parallel tubular members 40 that pass through support trough 38. As previously described, one or more attachment members 35 are used to attach the trough to the crack sealing apparatus 20.

Figure 8:
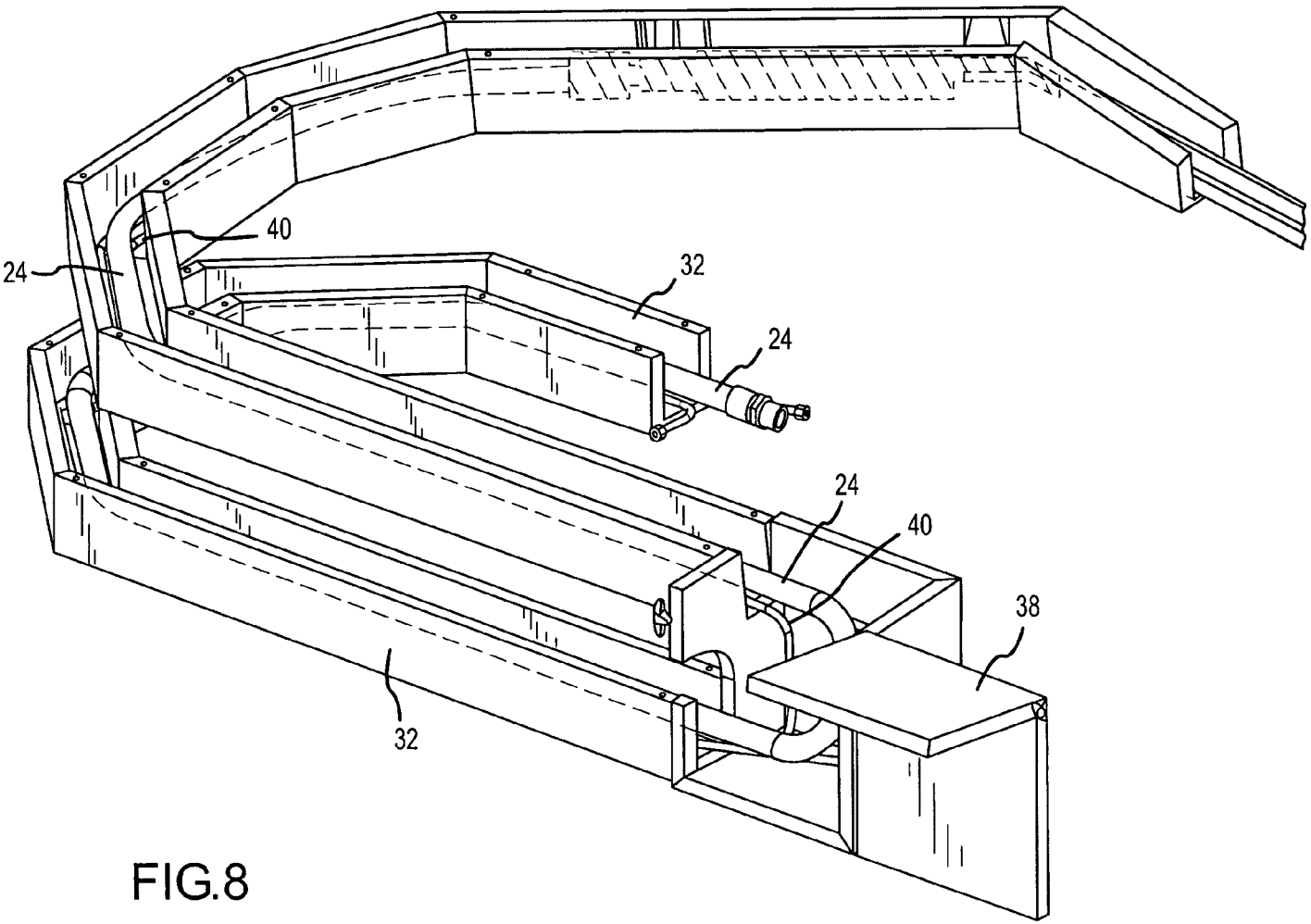
FIG. 8 is a perspective view of the upper and lower trough sections, hose, and applicator wand of the crack sealing apparatus of the present invention with portions of the hose shown in phantom.

A perspective view of the upper and lower trough sections 30, 32, hose 24, and applicator wand 48 of the crack sealing apparatus 20 of the present invention with portions of the hose 24 shown in phantom is illustrated in FIG. 8. As can be seen in FIG. 8, hose 24 is positioned so that it is seated directly on top of parallel tubular members 40 through which a hot liquid or gas is circulated. As previously described, a cover 34 as shown in FIGS. 3 through 5, such as rubber flap, may be attached across the open top of the trough to retain the heat that is generated by parallel tubular members 40 within the trough.

Upper and lower trough sections 30, 32 and support trough 38 are preferably comprised of an insulating type material which is able to retain heat generated by parallel tubular members 40 that are positioned within a bottom of the trough. Parallel tubular members 40 are preferably comprised of a heat conductive material, such as metal, for example, that enable heat from a hot liquid or gas circulated through the parallel tubular members 40 to be transferred to heat hose 24. Hose 24 is preferably comprised of a durable, flexible material that can be shaped as necessary to be positioned within the trough and that can also be positioned and moved as necessary to enable applicator wand 48 to apply sealant to cracks in a roadway.

The heated trough contained in the crack sealing apparatus of the present invention enable the hose and applicator gun to be continuously heated. Therefore, the hose and applicator gun can remain filled with sealant without a risk that the sealant will harden inside the hose and/or applicator wand. Accordingly, the need to purge or clean the hose and/or applicator wand is eliminated. Further, eliminating the need to clean and/or purge the hose and/or applicator wand eliminates the need for operators to handle dangerous chemicals and/or solutions used in the cleaning process thereby increasing safety in operating the apparatus.

Although the invention has been described herein in conjunction with the appended drawings, those skilled in the art will appreciate that the scope of the invention is not so limited. Modifications in the selection, design, and arrangement of the various components and elements discussed herein made be made without departing from the scope of the invention.

What is claimed is:

1. A crack sealing apparatus for sealing cracks in pavement comprising:

a repository for storing sealant;

a hose attached to the repository;

a heated trough and trough cover for retaining and enclosing the hose during application of the sealant; and a pump for transporting sealant from the repository through the hose.

2. The crack sealing apparatus of claim 1 wherein said trough is located around an outside of said repository.

3. The apparatus of claim 1 further comprising at least one attachment member for attaching the trough to the crack sealing apparatus.

4. The crack sealing apparatus of claim 1 wherein the trough comprises a plurality of trough sections.

5. The crack sealing apparatus of claim 4 wherein at least one of the trough sections comprises a support member for attaching other trough sections to one another.

6. The crack sealing apparatus of claim 1 wherein the trough includes a tubular member having a hot liquid or gas circulating therethrough.

7. The crack sealing apparatus of claim 6 wherein a transfer oil is circulated through the tubular member.

8. The crack sealing apparatus of claim 6 wherein the tubular member comprises a plurality of pipe members sequentially connected to one another.

9. The crack sealing apparatus of claim 6 further comprising a second, smaller trough member having a recirculation loop contained therein for retaining the hot liquid or gas, wherein the second, smaller trough member is connected to the tubular member so that the hot liquid or gas transported through the tubular member is directed back to the repository.

10. The crack sealing apparatus of claim 6 wherein the tubular member is positioned in the bottom of the trough and the hose containing sealant lies directly on top of the tubular member.

11. An apparatus for sealing cracks in pavement comprising:

a repository for storing and heating sealant;

a hose attached to the repository;

a pump for transporting sealant from the repository through the hose;

a trough for retaining and heating the hose; and a tubular member located within the trough having a hot liquid or gas circulating therethrough for heating sealant contained within the hose; and a cover for enclosing the hose inside the trough.

12. The apparatus of claim 11 wherein said cover comprises a rubber flap.

13. The apparatus of claim 11 further comprising an attachment member for attaching the trough to the apparatus.

14. The apparatus of claim 11 wherein the tubular member is located on a bottom interior surface of the trough.

15. The apparatus of claim 11 wherein the tubular member comprises a closed, continuous loop.

16. The apparatus of claim 14 wherein the tubular member comprises two parallel tube members having a pair of first ends and a pair of second ends wherein said pair of first ends are connected to said repository and said pair of second ends are connected to a second, smaller trough member for holding an applicator gun attached to the hose, the second, smaller trough having a recirculation loop contained therein for retaining and circulating the hot liquid or gas back toward the repository.

17. The apparatus of claim 11 wherein the trough comprises an upper trough section and a lower trough section with the upper trough section positioned directly above the lower trough section.

18. The apparatus of claim 17 wherein the trough further comprises a support section for connecting the upper trough section to the lower trough section.

19. The apparatus of claim 11 wherein said tubular member comprises a plurality of pipe members.

20. A crack sealing apparatus for sealing cracks in pavement comprising:

a repository for storing sealant;

a hose attached to the repository;

a heated housing for retaining the hose during application of the sealant;

a continuous, closed loop tubular member having a hot liquid or gas circulating therethrough wherein said tubular member is positioned within both the repository for the sealant and housing for the hose; and a pump for transporting sealant from the repository through the hose.

21. The crack sealing apparatus of claim 20 wherein a portion of said tubular member contained within the repository comprise at least one coil like shape.

* * * * *

UNITED STATES PATENT AND TRADEMARK OFFICE

CERTIFICATE OF CORRECTION

PATENT NO. : 7,008,136 B2
APPLICATION NO. : 10/707101
DATED : March 7, 2006
INVENTOR(S) : Hill It is certified that error appears in the above-identified patent and that said Letters Patent is hereby corrected as shown below:

On the title page (item 54) and Column 1 please delete “THROUGH” in the title and replace with --TROUGH--

Signed and Sealed this

Twelfth Day of September, 2006

JON W. DUDAS
*Director of the United States Patent and Trademark Office*